US010329650B2

(12) United States Patent
Cha et al.

(10) Patent No.: US 10,329,650 B2
(45) Date of Patent: Jun. 25, 2019

(54) HIGH MANGANESE STEEL

(71) Applicant: Hyundai Motor Company, Seoul (KR)

(72) Inventors: Sung Chul Cha, Seoul (KR); Seong Guk Son, Seoul (KR); Seung Hyun Hong, Seoul (KR); Soon Woo Kwon, Ansan-si (KR)

(73) Assignee: Hyundai Motor Company, Seoul (KR)

( * ) Notice: Subject to any disclaimer, the term of this patent is extended or adjusted under 35 U.S.C. 154(b) by 35 days.

(21) Appl. No.: 15/376,466

(22) Filed: Dec. 12, 2016

(65) Prior Publication Data

US 2018/0100220 A1 Apr. 12, 2018

(30) Foreign Application Priority Data

Oct. 12, 2016 (KR) ..... 10-2016-0131805

(51) Int. Cl.
*C22C 38/58* (2006.01)
*C22C 38/02* (2006.01)
(Continued)

(52) U.S. Cl.
CPC ..... *C22C 38/58* (2013.01); *C21D 6/005* (2013.01); *C21D 8/0205* (2013.01); *C21D 8/0226* (2013.01); *C21D 8/0236* (2013.01); *C22C 38/00* (2013.01); *C22C 38/02* (2013.01); *C22C 38/04* (2013.01); *C22C 38/06* (2013.01); *C22C 38/44* (2013.01); *C22C 38/46* (2013.01); *C22C 38/48* (2013.01); *C22C 38/50* (2013.01)

(58) Field of Classification Search
CPC ..... C22C 38/00; C22C 38/02; C22C 38/04; C22C 38/14; C22C 38/18; C22C 38/24; C22C 38/26; C22C 38/28; C22C 38/38; C22C 38/40; C22C 38/44; C22C 38/46; C22C 38/48; C22C 38/50; C22C 38/58; C21D 8/02; C21D 6/00; C21D 6/001; C21D 6/002; C21D 6/004; C21D 6/005; C21D 6/008; C21D 6/02; C21D 8/00; C21D 8/0205; C21D 8/0226; C21D 8/0236; C21D 8/1216; C21D 8/1222; C21D 8/1233; C21D 8/1227; C21D 8/1272; C21D 2211/00; C21D 2211/001; C21D 2211/004
See application file for complete search history.

(56) References Cited

U.S. PATENT DOCUMENTS 4,944,814 A 7/1990 Zimmer et al.
4,966,636 A * 10/1990 Wan ..... C22C 38/04 148/329

(Continued)

FOREIGN PATENT DOCUMENTS

EP 2653581 A2 10/2013
KR 20090070509 A 7/2009

(Continued)

*Primary Examiner* — Alexandra M Moore
(74) *Attorney, Agent, or Firm* — Slater Matsil, LLP

(57) ABSTRACT

Disclosed herein is a high manganese steel including: 0.5 to 1.2 wt % of carbon (C), 0.1 to 2.3 wt % of silicon (Si), 15 to 30 wt % of manganese (Mn), 7.0 to 13.0 wt % of aluminum (Al), 0.01 to 3.0 wt % of nickel (Ni), 0.01 to 0.5 wt % of chromium (Cr), 0.01 to 0.4 wt % of molybdenum (Mo), 0.01 to 0.5 wt % of vanadium (V), 0.005 to 0.3 wt % of niobium (Nb), 0.005 to 0.3 wt % of titanium (Ti), and remainder iron (Fe) and other inevitable impurities.

13 Claims, 2 Drawing Sheets

(51) Int. Cl.

| | |
|---|---|
| ***C22C 38/06*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C21D 6/00*** | (2006.01) |
| ***C21D 8/02*** | (2006.01) |
| ***C22C 38/00*** | (2006.01) |
| ***C22C 38/04*** | (2006.01) |

(56) References Cited

U.S. PATENT DOCUMENTS

| | | | | |
|---|---|---|---|---|
| 4,968,357 | A * | 11/1990 | Liu | C22C 38/04 148/329 |
| 2009/0010793 | A1 | 1/2009 | Becker et al. | |
| 2012/0160363 | A1 | 6/2012 | Jin et al. | |
| 2013/0295409 | A1 | 11/2013 | Chin et al. | |
| 2014/0007992 | A1 | 1/2014 | Balichev et al. | |
| 2016/0138146 | A1 | 5/2016 | Braun et al. | |
| 2016/0145706 | A1 | 5/2016 | Chung et al. | |
| 2016/0153077 | A1 | 6/2016 | Moon et al. | |

FOREIGN PATENT DOCUMENTS

| | | | |
|---|---|---|---|
| KR | 100957992 | B1 | 5/2010 |
| KR | 1020120065464 | A | 6/2012 |
| KR | 1020130100215 | A | 9/2013 |
| KR | 1020140026361 | A | 3/2014 |
| KR | 1020160078840 | A | 7/2016 |
| WO | 2012092122 | A1 | 7/2012 |
| WO | 2012095232 | A1 | 7/2012 |

* cited by examiner

HIGH MANGANESE STEEL

CROSS-REFERENCE TO RELATED APPLICATIONS

The present application claims priority to Korean Patent Application No. 10-2016-0131805, filed Oct. 12, 2016, the entire contents of which is incorporated herein for all purposes by this reference.

TECHNICAL FIELD

The present invention relates to a high manganese steel.

BACKGROUND

The conventional high manganese steels have excellent strength and elongation by controlling contents of manganese (Mn) and aluminum (Al) to control stacking fault energy (SFE). However, the conventional high manganese steels still have a high density, and thus, it is not possible to expect improvement of fuel efficiency by lightweight when it is applied to bodywork components such as a center pillar, a front side member, a side sill, a front pillar, a floor cross member, etc.

Korean Patent Laid-Open Publication No. KR 10-2016-0078840 aims to produce high manganese having high yield strength and high elongation by increasing the content of manganese (Mn), but has a limitation in that the content of aluminum (Al) is only 2.5 to 5.0 wt %, such that a density is high.

The contents described as the related art have been provided only for assisting in the understanding for the background of the present invention and should not be considered as corresponding to the related art known to those skilled in the art.

SUMMARY

Embodiments of the present invention provide a high manganese steel capable of having high strength and high elongation by controlling contents of manganese (Mn), aluminum (Al), etc., and capable of being lightened by lowering a density.

According to an exemplary embodiment of the present invention, a high manganese steel includes: 0.5 to 1.2 wt % of carbon (C), 0.1 to 2.3 wt % of silicon (Si), 15 to 30 wt % of manganese (Mn), 7.0 to 13.0 wt % of aluminum (Al), 0.01 to 3.0 wt % of nickel (Ni), 0.01 to 0.5 wt % of chromium (Cr), 0.01 to 0.4 wt % of molybdenum (Mo), 0.01 to 0.5 wt % of vanadium (V), 0.005 to 0.3 wt % of niobium (Nb), 0.005 to 0.3 wt % of titanium (Ti), and remainder iron (Fe) and other inevitable impurities.

A density may be 7.1 (g/cm$^3$) or less.

Yield strength may be 705 MPa or more, and tensile strength may be 1120 MPa or more.

An elongation may be 41.6% or more, and a work hardening exponent (n) may be 0.208 or more.

Stacking fault energy (SFE) may be 35.3 to 44.1 (mJ/m$^2$).

A fraction of carbide present in an organization may be 1.34% or more.

A fraction of inclusion present in an organization may be 0.062% or less.

A β-Mn phase may be formed in an organization by containing 25 to 30 wt % of manganese (Mn).

According to another embodiment, a high manganese steel consists essentially of 0.5 to 1.2 wt % of carbon (C), 0.1 to 2.3 wt % of silicon (Si), 15 to 30 wt % of manganese (Mn), 7.0 to 13.0 wt % of aluminum (Al), 0.01 to 3.0 wt % of nickel (Ni), 0.01 to 0.5 wt % of chromium (Cr), 0.01 to 0.4 wt % of molybdenum (Mo), 0.01 to 0.5 wt % of vanadium (V), 0.005 to 0.3 wt % of niobium (Nb), 0.005 to 0.3 wt % of titanium (Ti), and iron (Fe). The high manganese steel has a density of 7.1 (g/cm$^3$) or less, a yield strength of 705 MPa or more, a tensile strength of 1120 MPa or more, an elongation of 41.6% or more, and a work hardening exponent (n) of 0.208 or more.

According to another embodiment, a high manganese steel consists essentially of 0.5 to 1.2 wt % of carbon (C), 0.1 to 2.3 wt % of silicon (Si), 15 to 30 wt % of manganese (Mn), 7.0 to 13.0 wt % of aluminum (Al), 0.01 to 3.0 wt % of nickel (Ni), 0.01 to 0.5 wt % of chromium (Cr), 0.01 to 0.4 wt % of molybdenum (Mo), 0.01 to 0.5 wt % of vanadium (V), 0.005 to 0.3 wt % of niobium (Nb), 0.005 to 0.3 wt % of titanium (Ti), and iron (Fe). The high manganese steel has a stacking fault energy (SFE) of 35.3 to 44.1 (mJ/m$^2$).

DETAILED DESCRIPTION OF ILLUSTRATIVE EMBODIMENTS

Figure 1:
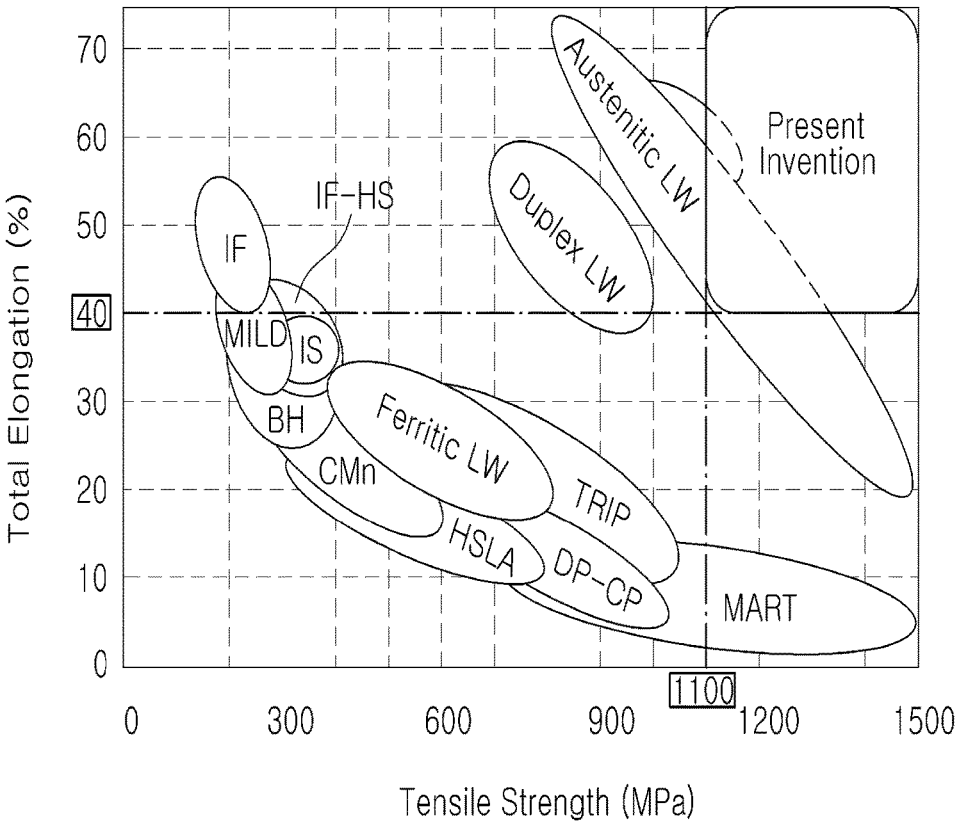
FIG. 1 is a graph showing properties of a high manganese steel according to the present invention.

Hereinafter, preferable exemplary embodiments of the present invention will be described with reference to the accompanying drawings.

A high manganese steel according to the present invention includes: 0.5 to 1.2 wt % of carbon (C), 0.1 to 2.3 wt % of silicon (Si), 15 to 30 wt % of manganese (Mn), 7.0 to 13.0 wt % of aluminum (Al), 0.01 to 3.0 wt % of nickel (Ni), 0.01 to 0.5 wt % of chromium (Cr), 0.01 to 0.4 wt % of molybdenum (Mo), 0.01 to 0.5 wt % of vanadium (V), 0.005 to 0.3 wt % of niobium (Nb), 0.005 to 0.3 wt % of titanium (Ti), and remainder iron (Fe) and other inevitable impurities.

Hereinafter, a reason for limiting condition of steel components in the high manganese steel of the present invention is described in detail.

Carbon (C): 0.5 to 1.2%

Carbon (C) is an austenite stabilizing element and acts to increase strength and stacking fault energy. (Fe, Mn)3AlC type κ-carbide, VC, (V,Nb)C, etc., are formed. It is possible to deduce optimum strength and elongation by controlling contents under condition of high contents of manganese (Mn) and aluminum (Al).

When the content of carbon (C) is less than 0.5%, machining crack may occur due to formation of α-martensite. Production of carbides may be reduced and strength and ductility may be reduced. On the other hand, when the content of carbon (C) is more than 1.2%, high-strength brittleness may occur. An elongation may be reduced by precipitation of cementite. Further, weldability may be lowered and workability may be lowered due to excessive slip deformation. The stacking fault energy may be excessively increased. Accordingly, the content of carbon (C) is limited to 0.5 to 1.2%.

Silicon (Si): 0.1 to 2.3%

Silicon (Si) may act as a deoxidizer and may act to strength solidification. Yield strength may be increased. When high content manganese is added, formation of a manganese oxide layer may be suppressed. Corrosion may be prevented and surface quality may be improved.

When the content of silicon (Si) is less than 0.1%, strength may be lowered and deoxidation effect may not be large. On the other hand, when the content of silicon (Si) is more than 2.3%, toughness, quenching ability, and weldability may be lowered. At the time of hot rolling, acidity may be deteriorated and plating ability may be deteriorated by the formation of the oxide layer. Accordingly, the content of silicon (S) is limited to 0.1 to 2.3%.

Manganese (Mn): 15 to 30%

Manganese (Mn) is an austenite stabilizing element and may contribute to stabilization of stacking fault energy. A β-manganese (Mn) phase may be formed, and thus, mechanical properties may be largely changed.

When the content of manganese (Mn) is 15% or less, ferrite/martensite may be generated in a cooling process due to a reduction in stability of the austenite. Accordingly, the ductility may be reduced. On the other hand, when the content of manganese (Mn) is more than 30%, mechanical properties may be lowered. At the time of hot rolling, crack may occur. Accordingly, the content of manganese (Mn) is limited to 15 to 30%.

Aluminum (Al): 7.0 to 13.0%

Aluminum (Al) is a deoxidizer and may improve the ductility. It is possible to achieve lightweight and to increase the stacking fault energy though a low density. Due to suppression of formation of ε-martensite phase, the ductility may be improved, and corrosion resistance, oxidation resistance, and high temperature toughness may be increased. Moldability may be improved. A strain softening effect may be enhanced by controlling production of κ-carbide. A density of a slip band may be lowered and strain hardening may be reduced.

When the content of aluminum (Al) is less than 7.0%, lightweight may be insignificant and the ductility may be lowered. In addition, the production of the κ-carbide may be lowered, and moldability may be lowered. Corrosion resistance and oxidation resistance may be lowered. On the other hand, when the content of aluminum (Al) is more than 13.0%, castability may be lowered, and at the time of hot rolling, surface quality may be deteriorated due to surface oxidation. The elongation may be lowered, and cold rolling property may be lowered. Accordingly, the content of aluminum (Al) is limited to 7.0 to 13.0%.

Nickel (Ni): 0.01 to 3.0%

By adding nickel (Ni), (Fe,Ni)Al which is a B2 phase, may be precipitated, and may be utilized as a reinforcing phase. The B2 phase of 1 μm or less in an austenite base may be precipitated up to 40 vol. %.

When the content of nickel (Ni) is less than 0.01%, the toughness may be lowered, and impact resistance may be lowered. On the other hand, when the content of nickel (Ni) is more than 3.0%, the strength may be increased, but the toughness may be reduced rapidly. Accordingly, the content of nickel (Ni) is limited to 0.01 to 3.0%.

Chromium (Cr): 0.01 to 0.5%

Chromium (Cr) is an element that forms carbide. The chromium may act to appropriately delay the production of κ-carbide. Stability at high temperature may be increased and the quenching ability may be improved. Further, hardenability may be provided, and an organization may be refined.

When the content of chromium (Cr) is less than 0.01%, the strength may be lowered and a precipitation amount of the carbide may be reduced. On the other hand, when the content of chromium (Cr) is more than 0.5%, the strength may be increased, but the toughness may be reduced rapidly. Accordingly, the content of chromium (Cr) is limited to 0.01 to 0.5%.

Molybdenum (Mo): 0.01 to 0.4%

Molybdenum (Mo) is an element that forms carbide. Brittleness, corrosion resistance and heat resistance may be improved. In addition, cutting ability may be increased.

When the content of molybdenum (Mo) is less than 0.01%, the strength may be lowered and a precipitation amount of the carbide may be reduced. Brittleness resistance may be lowered. On the other hand, when the content of molybdenum (Mo) is more than 0.4%, a bainite fraction may be reduced and the elongation may be lowered. Accordingly, the content of molybdenum (Mo) is limited to 0.01 to 0.4%.

Vanadium (V): 0.01 to 0.5%

Vanadium (V) is an element that forms carbide. The vanadium may reduce the density, may preserve the strength, and may provide excellent balance of strength and elongation. Fine precipitates may be formed. (V,Nb)C may be formed by adding niobium (Nb).

When the content of vanadium (V) is less than 0.01%, the strength may be lowered and a precipitation amount of the carbide may be reduced. Brittleness resistance may be lowered. On the other hand, when the content of vanadium (V) is more than 0.5%, formation of the carbide may be saturated and the elongation may be lowered. Accordingly, the content of vanadium (V) is limited to 0.01 to 0.5%.

Niobium (Nb): 0.005 to 0.3%

Niobium (Nb) is an element that forms carbide. A crystal grain may be refined, and the density may be lowered. The strength may be preserved, and balance of strength and elongation may be excellent. Fine precipitates may be formed. (V,Nb)C may be formed by adding vanadium (V).

When the content of niobium (Nb) is less than 0.005%, the carbide formation may be insignificant. The organization may be coarsened and the strength may be lowered. On the other hand, when the content of niobium (Nb) is more than 0.3%, the formation of the carbide may be saturated, a crystal grain boundary segregation may be formed, and precipitation phase may be coarsened. Accordingly, the content of niobium (Nb) is limited to 0.005 to 0.3%.

Titanium (Ti): 0.005 to 0.3%

Titanium (Ti) is an element that forms carbide. The crystal grain may be refined, and the density may be lowered. The titanium may preserve the strength, and may provide excellent balance of strength and elongation.

When the content of titanium (Ti) is less than 0.005%, an effect that the strength is improved and the density is lowered may be insignificant. On the other hand, when the content of titanium (Ti) is more than 0.3%, the formation of the carbide may be saturated, the crystal grain boundary segregation may be formed, and the precipitation phase may be coarsened. At the time of cold rolling, crack may occur, and the weldability may be lowered. Accordingly, the content of titanium (Ti) is limited to 0.005 to 0.3%.

Examples and Comparative Examples on the basis of specimens produced with different composition components and contents are described in Tables 1 and 2 below. The samples were subjected to reheating at 1100 to 1300° C., hot rolling at about 800 to 1000° C., coiling at about 500° C., cold rolling at ambient temperature, and cold-rolling annealing at 700 to 900° C. to be used.

TABLE 1

| wt % | Carbon (C) | Silicon (Si) | Manganese (Mn) | Aluminum (Al) | Nickel (Ni) | Chromium (Cr) | Molybdenum (Mo) | Vanadium (V) | Niobium (Nb) | Titanium (Ti) |
|---|---|---|---|---|---|---|---|---|---|---|
| Example 1 | 0.52 | 0.15 | 15.3 | 7.2 | 0.09 | 0.12 | 0.05 | 0.04 | 0.009 | 0.007 |
| Example 2 | 0.84 | 2.25 | 24.3 | 10.5 | 1.81 | 0.39 | 0.12 | 0.23 | 0.21 | 0.16 |
| Example 3 | 1.19 | 1.38 | 29.8 | 12.7 | 2.76 | 0.48 | 0.37 | 0.46 | 0.28 | 0.27 |
| Comparative Example 1 | 0.48 | 1.66 | 15.2 | 7.6 | 0.08 | 0.16 | 0.03 | 0.06 | 0.006 | 0.006 |
| Comparative Example 2 | 1.23 | 0.12 | 22.7 | 11.5 | 1.86 | 0.34 | 0.29 | 0.33 | 0.27 | 0.19 |
| Comparative Example 3 | 0.62 | 0.08 | 23.2 | 12.3 | 2.71 | 0.42 | 0.36 | 0.46 | 0.26 | 0.09 |
| Comparative Example 4 | 0.76 | 2.35 | 28.2 | 8.3 | 0.05 | 0.24 | 0.12 | 0.07 | 0.019 | 0.02 |
| Comparative Example 5 | 1.07 | 0.19 | 14.7 | 11.2 | 1.48 | 0.36 | 0.16 | 0.45 | 0.25 | 0.006 |
| Comparative Example 6 | 0.53 | 2.14 | 30.3 | 12.3 | 2.15 | 0.41 | 0.47 | 0.46 | 0.22 | 0.21 |
| Comparative Example 7 | 0.57 | 1.84 | 25.5 | 6.9 | 2.56 | 0.03 | 0.35 | 0.46 | 0.25 | 0.005 |
| Comparative Example 8 | 0.74 | 1.52 | 17.6 | 13.2 | 0.29 | 0.09 | 0.15 | 0.43 | 0.009 | 0.13 |
| Comparative Example 9 | 1.14 | 0.11 | 21.2 | 10.9 | 0.007 | 0.29 | 0.32 | 0.23 | 0.19 | 0.21 |
| Comparative Example 10 | 0.59 | 2.11 | 29.4 | 12.1 | 3.05 | 0.25 | 0.35 | 0.46 | 0.28 | 0.014 |
| Comparative Example 11 | 0.77 | 1.42 | 19.3 | 8.9 | 0.69 | 0.008 | 0.19 | 0.03 | 0.006 | 0.007 |
| Comparative Example 12 | 1.19 | 0.33 | 27.1 | 9.4 | 1.01 | 0.52 | 0.23 | 0.41 | 0.11 | 0.15 |
| Comparative Example 13 | 0.64 | 2.06 | 26.5 | 12.7 | 2.72 | 0.44 | 0.006 | 0.46 | 0.18 | 0.008 |
| Comparative Example 14 | 0.92 | 1.72 | 16.2 | 9.3 | 0.03 | 0.32 | 0.41 | 0.14 | 0.10 | 0.23 |
| Comparative Example 15 | 0.65 | 1.92 | 19.9 | 7.1 | 0.29 | 0.11 | 0.015 | 0.008 | 0.007 | 0.20 |
| Comparative Example 16 | 1.06 | 0.42 | 24.1 | 9.5 | 1.61 | 0.22 | 0.26 | 0.53 | 0.29 | 0.21 |
| Comparative Example 17 | 0.98 | 0.35 | 28.1 | 9.2 | 1.48 | 0.14 | 0.18 | 0.53 | 0.004 | 0.19 |
| Comparative Example 18 | 0.71 | 1.63 | 21.3 | 12.4 | 2.73 | 0.38 | 0.36 | 0.46 | 0.31 | 0.12 |
| Comparative Example 19 | 0.94 | 1.44 | 16.3 | 8.2 | 0.69 | 0.17 | 0.22 | 0.16 | 0.007 | 0.003 |
| Comparative Example 20 | 1.15 | 0.74 | 20.9 | 9.5 | 1.77 | 0.48 | 0.16 | 0.27 | 0.16 | 0.32 |

TABLE 2

| | Density ($g/cm^3$) | Yield Strength (MPa) | Tensile Strength (MPa) | Elongation (%) | Work hardening exponent (n) | Stacking Fault Energy ($mJ/m^2$) | Carbide Fraction (%) | Inclusion Fraction (%) |
|---|---|---|---|---|---|---|---|---|
| Example1 | 7.1 | 705 | 1120 | 41.6 | 0.208 | 35.3 | 1.34 | 0.062 |
| Example2 | 6.8 | 746 | 1147 | 45.2 | 0.226 | 38.2 | 1.55 | 0.041 |
| Example3 | 6.5 | 820 | 1198 | 50.3 | 0.252 | 44.1 | 1.92 | 0.045 |
| Comparative Example 1 | 6.9 | 665 | 1010 | 40.5 | 0.203 | 26.2 | 0.46 | 0.051 |
| Comparative Example 2 | 7.3 | 725 | 1199 | 32.6 | 0.163 | 50.6 | 1.96 | 0.057 |
| Comparative Example 3 | 6.7 | 685 | 1006 | 42.5 | 0.213 | 35.8 | 1.32 | 0.053 |
| Comparative Example 4 | 6.8 | 822 | 1169 | 34.2 | 0.171 | 32.1 | 1.45 | 0.052 |

TABLE 2-continued

| | Density ($g/cm^3$) | Yield Strength (MPa) | Tensile Strength (MPa) | Elongation (%) | Work hardening exponent (n) | Stacking Fault Energy ($mJ/m^2$) | Carbide Fraction (%) | Inclusion Fraction (%) |
|---|---|---|---|---|---|---|---|---|
| Comparative Example 5 | 6.8 | 748 | 1149 | 31.5 | 0.158 | 28.8 | 1.22 | 0.042 |
| Comparative Example 6 | 6.7 | 695 | 1105 | 41.2 | 0.206 | 50.1 | 1.49 | 0.053 |
| Comparative Example 7 | 7.7 | 715 | 1132 | 41.3 | 0.207 | 19.2 | 0.69 | 0.038 |
| Comparative Example 8 | 6.2 | 736 | 1136 | 34.2 | 0.171 | 39.2 | 1.03 | 0.134 |
| Comparative Example 9 | 7.0 | 735 | 1136 | 31.2 | 0.156 | 34.3 | 1.24 | 0.035 |
| Comparative Example 10 | 6.8 | 774 | 1146 | 31.2 | 0.156 | 36.6 | 1.01 | 0.062 |
| Comparative Example 11 | 7.1 | 695 | 1095 | 40.2 | 0.201 | 33.2 | 0.62 | 0.052 |
| Comparative Example 12 | 7.1 | 782 | 1163 | 34.6 | 0.173 | 36.2 | 1.42 | 0.064 |
| Comparative Example 13 | 7.1 | 666 | 998 | 41.2 | 0.206 | 35.6 | 1.01 | 0.058 |
| Comparative Example 14 | 6.9 | 813 | 1173 | 33.6 | 0.168 | 37.4 | 1.26 | 0.055 |
| Comparative Example 15 | 6.6 | 653 | 995 | 44.7 | 0.224 | 32.6 | 0.36 | 0.044 |
| Comparative Example 16 | 6.9 | 770 | 1148 | 36.6 | 0.183 | 34.5 | 1.53 | 0.038 |
| Comparative Example 17 | 7.1 | 668 | 1002 | 40.4 | 0.202 | 36.2 | 0.95 | 0.051 |
| Comparative Example 18 | 6.6 | 744 | 1144 | 33.2 | 0.166 | 35.1 | 1.06 | 0.062 |
| Comparative Example 19 | 7.3 | 669 | 1003 | 43.2 | 0.216 | 36.4 | 0.84 | 0.126 |
| Comparative Example 20 | 6.9 | 720 | 1139 | 36.9 | 0.185 | 34.6 | 1.02 | 0.042 |

Table 1 shows composition components and contents of Examples and Comparative Examples. In addition, Table 2 shows the density, yield strength, tensile strength, elongation, work hardening exponent, stacking fault energy, carbide fraction, and inclusion fraction of Examples and Comparative Examples.

The density was measured using a density meter such as a underwater substitution type hydrometer, etc., and the yield strength, tensile strength and elongation were measured according to KS B 0802, and the work hardening exponent was calculated using an average value for a strain rate ranging from 5 to 15%. The stacking fault energy was estimated by using a transmission electron microscopy (TEM), etc.

It could be confirmed that the high manganese steel according to the present invention had excellent strength and high elongation as shown in Table 2 and FIG. 1.

In Comparative Example 1 and Comparative Example 2, only the content of carbon (C) was controlled to be under or over the limit range of the high manganese steel according to the present invention while the contents of other components were controlled to be the same range as those of Examples within the limit range of the high manganese steel according to the present invention.

As shown in Table 2, it could be confirmed that when the content of carbon (C) was under the limit range, the yield strength, the tensile strength, and the carbide fraction were lower than those of Examples, and when the content of carbon (C) was over the limit range, the elongation, and the work hardening exponent were lower than those of Examples.

In Comparative Example 3 and Comparative Example 4, only the content of silicon (Si) was controlled to be under or over the limit range of the high manganese steel according to the present invention while the contents of other components were controlled to be the same range as those of Examples within the limit range of the high manganese steel according to the present invention.

As shown in Table 2, it could be confirmed that when the content of silicon (Si) was under the limit range, the yield strength and the tensile strength were lower than those of Examples, and when the content of silicon (Si) was over the limit range, the elongation and the work hardening exponent were lower than those of Examples.

In Comparative Example 5 and Comparative Example 6, only the content of manganese (Mn) was controlled to be under or over the limit range of the high manganese steel according to the present invention while the contents of other components were controlled to be the same range as those of Examples within the limit range of the high manganese steel according to the present invention.

As shown in Table 2, it could be confirmed that when the content of manganese (Mn) was under the limit range, the elongation and the work hardening exponent were lower than those of Examples, and when the content of manganese (Mn) was over the limit range, the yield strength and the tensile strength were lower than those of Examples.

In Comparative Example 7 and Comparative Example 8, only the content of aluminum (Al) was controlled to be under or over the limit range of the high manganese steel according to the present invention while the contents of other components were controlled to be the same range as those of Examples within the limit range of the high manganese steel according to the present invention.

As shown in Table 2, it could be confirmed that when the content of aluminum (Al) was under the limit range, the density was higher than that of Examples, and when the content of aluminum (Al) was over the limit range, the elongation and the work hardening exponent were lower than those of Examples.

In Comparative Example 9 and Comparative Example 10, only the content of nickel (Ni) was controlled to be under or over the limit range of the high manganese steel according to the present invention while the contents of other components were controlled to be the same range as those of Examples within the limit range of the high manganese steel according to the present invention.

As shown in Table 2, it could be confirmed that when the content of nickel (Ni) was under or over the limit range, the elongation and the work hardening exponent of were lower than those of Examples.

In Comparative Example 11 and Comparative Example 12, only the content of chromium (Cr) was controlled to be under or over the limit range of the high manganese steel according to the present invention while the contents of other components were controlled to be the same range as those of Examples within the limit range of the high manganese steel according to the present invention.

As shown in Table 2, it could be confirmed that when the content of chromium (Cr) was under the limit range, the yield strength and the tensile strength were lower than those of Examples, and when the content of chromium (Cr) was over the limit range, the elongation and the work hardening exponent were lower than those of Examples.

In Comparative Example 13 and Comparative Example 14, only the content of molybdenum (Mo) was controlled to be under or over the limit range of the high manganese steel according to the present invention while the contents of other components were controlled to be the same range as those of Examples within the limit range of the high manganese steel according to the present invention.

As shown in Table 2, it could be confirmed that when the content of molybdenum (Mo) was under the limit range, the yield strength and the tensile strength were lower than those of Examples, and when the content of molybdenum (Mo) was over the limit range, the elongation and the work hardening exponent were lower than those of Examples.

In Comparative Example 15 and Comparative Example 16, only the content of vanadium (V) was controlled to be under or over the limit range of the high manganese steel according to the present invention while the contents of other components were controlled to be the same range as those of Examples within the limit range of the high manganese steel according to the present invention.

As shown in Table 2, it could be confirmed that when the content of vanadium (V) was under the limit range, the yield strength and the tensile strength were lower than those of Examples, and when the content of vanadium (V) was over the limit range, the elongation and the work hardening exponent were lower than those of Examples.

In Comparative Example 17 and Comparative Example 18, only the content of niobium (Nb) was controlled to be under or over the limit range of the high manganese steel according to the present invention while the contents of other components were controlled to be the same range as those of Examples within the limit range of the high manganese steel according to the present invention.

As shown in Table 2, it could be confirmed that when the content of niobium (Nb) was under the limit range, the yield strength and the tensile strength were lower than those of Examples, and when the content of niobium (Nb) was over the limit range, the elongation and the work hardening exponent were lower than those of Examples.

In Comparative Example 19 and Comparative Example 20, only the content of titanium (Ti) was controlled to be under or over the limit range of the high manganese steel according to the present invention while the contents of other components were controlled to be the same range as those of Examples within the limit range of the high manganese steel according to the present invention.

As shown in Table 2, it could be confirmed that when the content of titanium (Ti) was under the limit range, the density was higher than that of Examples, and the yield strength and the tensile strength were lower than those of Examples, and when the content of titanium (Ti) was over the limit range, the elongation and the work hardening exponent were lower than those of Examples.

Due to the addition of aluminum (Al), overall density of the steel may be lowered to achieve lightweight. Preferably, the density of the high manganese steel according to the present invention may be 7.1 (g/cm$^3$) or less. The aluminum (Al) may replace iron (Fe) as a substitutional lightweight element. An atomic weight of iron (Fe) is two times higher than that of aluminum (Al). On the contrary, an atomic radius of iron (Fe) is smaller than that of aluminum (Al). Thus, when aluminum (Al) replaces iron (Fe), the density of the steel is lowered by expanding a lattice.

On the other hand, even if aluminum (Al) replaces iron (Fe), it is possible to increase specific strength while maintaining the same level of strength. In addition, the formation of ε-martensite phase having deformation twinning defect and brittleness may be delayed to increase resistance to hydrogen embrittlement.

Preferably, the high manganese steel according to the present invention may have yield strength of 705 MPa or more, and tensile strength of 1120 MPa or more. In order to achieve lightweight and thinness, it is required to satisfy that the yield strength is 700 MPa or more and the tensile strength is 1100 MPa or more. As confirmed from Table 2, Example 1 having the lowest yield strength and tensile strength had yield strength of 705 MPa and tensile strength of 1120 MPa.

This is related to the formation of fine carbides due to the addition of chromium (Cr), molybdenum (Mo), vanadium (V), niobium (Nb), titanium (Ti), etc., and preferably, the fraction of carbides such as (Fe, Mn)3AlC, VC, (V,Nb)C, etc., is present at 1% or more, such that the strength and the toughness of the steel may be increased. As confirmed from Table 2, Example 1 having the lowest carbide fraction had a carbide fraction of 1.34%.

Meanwhile, since the inclusion may cause deterioration of the strength and fatigue durability, it is preferable that the inclusion fraction is present at 0.07% or less. As confirmed from Table 2, Example 1 having the highest inclusion fraction had an inclusion fraction of 0.062%.

It is preferable that the elongation is 40% or more. This is a numerical value for securing the moldability and workability. The elongation results from the balance of strength and elongation according to the control of contents of vanadium (V), niobium (Nb), and titanium (Ti). As confirmed from Table 2, Example 1 having the lowest elongation had an elongation of 41.6%.

The work hardening exponent indicates a hardening degree at the time of machining, which means a strain rate at the moment when stress begins to decrease. Therefore, the higher the work hardening exponent, the higher the moldability. As a numerical value for securing such moldability, the n value is preferably 0.2 or more. As confirmed from Table 2, Example 1 having the lowest work hardening exponent had a work hardening exponent of 0.208.

In general, for steels having a high content of manganese (Mn) related with stacking fault energy, a deformation behavior may depend on the stacking fault energy. The lower the stacking fault energy, the lower the deformation twinning defect and the organization recovery, and the lower the moldability. On the contrary, as the stacking fault energy becomes higher, a limited strain level is exceeded, and thus, the workability is deteriorated. Accordingly, the stacking fault energy preferably has a range of 30 to 50 ($mJ/m^2$). As shown in Table 2, it could be appreciated that Examples 1 to 3 had the stacking fault energy within the above-described range.

The β-Mn phase is formed in a microstructure depending on the composition of carbon (C), manganese (Mn) and aluminum (Al). Due to the formation of the β-Mn phase, mechanical properties such as yield strength, tensile strength and elongation may be changed.

Figure 2:
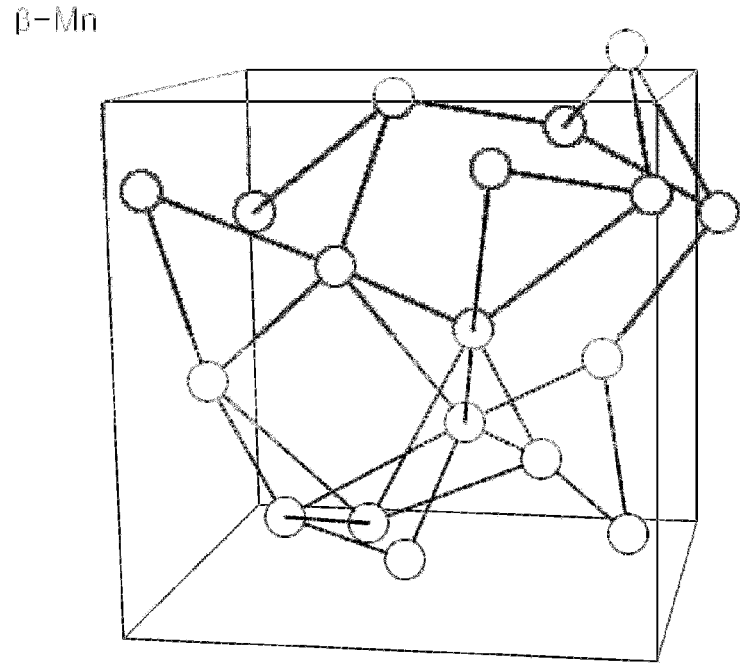
FIG. 2 schematically shows a structure of β-Mn phase according to the present invention.

The β-Mn phase has a cubic structure as shown in FIG. 2. The β-Mn phase may be produced when the content of manganese (Mn) is 25 wt % or more at the time of Fe—Al—Mn—C phase transformation. The β-Mn phase may be formed mainly at an interface of an austenite crystal grain boundary or an austenite and ferrite phase.

Specifically, when the aluminum has a low content of 10 wt % or less, the β-Mn phase and the ferrite grow while forming a colony in which a lamellar form is mixed. When aluminum (Al) has a high content of 10 wt % or more, the β-Mn phase rapidly grows along the austenite grain boundary, and exhibits a growth behavior while having a Widmanstatten structure inside the grain.

The high manganese steel according to the present invention may control the contents of elements such as manganese (Mn) and aluminum (Al), etc., as described above, thereby having excellent strength and elongation, and simultaneously, lowering the density to achieve lightweight. Therefore, the high manganese steel may have high strength and excellent workability and moldability, may achieve thinness and integration of components, and may be applied to bodywork components such as a center pillar, a front side member, a side sill, a front pillar, and a floor cross member, etc.

According to the high manganese steel of the present invention as described above, the carbide may be formed by controlling the contents of manganese (Mn), aluminum (Al), etc., such that the yield strength and the tensile strength may be high, and the elongation and the work hardening exponent may be high.

Further, it is possible to achieve the lightweight by lowering the density.

Hereinabove, although the present invention has been described with reference to exemplary embodiments and the accompanying drawings, the present invention is not limited thereto, but may be variously modified and altered by those skilled in the art to which the present invention pertains without departing from the spirit and scope of the present invention claimed in the following claims.

What is claimed is:

1. A high manganese steel comprising:

0.5 to 1.2 wt % of carbon (C), 0.1 to 2.3 wt % of silicon (Si), 15 to 30 wt % of manganese (Mn), 10.5 to 13.0 wt % of aluminum (Al), 0.01 to 3.0 wt % of nickel (Ni), 0.01 to 0.5 wt % of chromium (Cr), 0.01 to 0.4 wt % of molybdenum (Mo), 0.01 to 0.5 wt % of vanadium (V), 0.005 to 0.3 wt % of niobium (Nb), 0.005 to 0.3 wt % of titanium (Ti), and remainder iron (Fe) and other inevitable impurities, wherein a β-manganese phase is formed in the high manganese steel, and wherein the high manganese steel has a density of 7.0 ($g/cm^3$) or less, an elongation of 41.6% or more, and a work hardening exponent (n) of 0.226 or more.

2. The high manganese steel of claim 1, wherein the high manganese steel has a yield strength of 705 MPa or more, and tensile strength of 1120 MPa or more.

3. The high manganese steel of claim 1, wherein the high manganese steel has a stacking fault energy (SFE) of 35.3 to 44.1 ($mJ/m^2$).

4. The high manganese steel of claim 1, wherein a fraction of carbide present in the high manganese steel is 1.34% or more.

5. The high manganese steel of claim 1, wherein a fraction of inclusion present in the high manganese steel is 0.062% or less.

6. A high manganese steel comprising 0.5 to 1.2 wt % of carbon (C), 0.1 to 2.3 wt % of silicon (Si), 15.3 to 30 wt % of manganese (Mn), 10.5 to 13.0 wt % of aluminum (Al), 0.01 to 3.0 wt % of nickel (Ni), 0.01 to 0.5 wt % of chromium (Cr), 0.01 to 0.4 wt % of molybdenum (Mo), 0.01 to 0.5 wt % of vanadium (V), 0.005 to 0.3 wt % of niobium (Nb), 0.005 to 0.3 wt % of titanium (Ti), and remainder iron (Fe) and other inevitable impurities, wherein the high manganese steel has a density of 7.0 ($g/cm^3$) or less, an elongation of 41.6% or more, and a work hardening exponent (n) of 0.226 or more.

7. The high manganese steel of claim 6, wherein a β-manganese phase is formed in the high manganese steel.

8. The high manganese steel of claim 6, wherein the high manganese steel has a yield strength of 705 MPa or more, and tensile strength of 1120 MPa or more.

9. The high manganese steel of claim 6, wherein the high manganese steel has a stacking fault energy (SFE) of 35.3 to 44.1 ($mJ/m^2$).

10. The high manganese steel of claim 6, wherein a fraction of carbide present in the high manganese steel is 1.34% or more.

11. The high manganese steel of claim 6, wherein a fraction of inclusion present in the high manganese steel is 0.062% or less.

12. The high manganese steel of claim 6, wherein the high manganese steel contains 25 to 30 wt % of manganese (Mn).

13. A high manganese steel consisting essentially of 0.5 to 1.2 wt % of carbon (C), 0.1 to 2.3 wt % of silicon (Si), 15.3 to 30.3 of manganese (Mn), 10.5 to 13.0 wt % of aluminum (Al), 0.01 to 3.0 wt % of nickel (Ni), 0.01 to 0.5 wt % of chromium (Cr), 0.01 to 0.4 wt % of molybdenum (Mo), 0.01 to 0.5 wt % of vanadium (V), 0.005 to 0.3 wt % of niobium (Nb), 0.005 to 0.3 wt % of titanium (Ti), and iron (Fe), wherein the high manganese steel has a density of 7.1 ($g/cm^3$) or less, a yield strength of 705 MPa or more, a tensile strength of 1120 MPa or more, an elongation of 41.6% or more, and a work hardening exponent (n) of 0.208 or more, wherein a β-manganese phase is formed in the high manganese steel, and wherein the high manganese steel has a density of 7.0 ($g/cm^3$) or less, and a work hardening exponent (n) of 0.226 or more.

* * * * *